US012723805B2

(12) United States Patent
Eget

(10) Patent No.: US 12,723,805 B2
(45) Date of Patent: Sep. 1, 2026

(54) INSULATION PANEL SEAL

(71) Applicant: Hill Phoenix, Inc., Conyers, GA (US)

(72) Inventor: Larry W. Eget, Midlothian, VA (US)

(73) Assignee: Hill Phoenix, Inc., Conyers, GA (US)

( * ) Notice: Subject to any disclaimer, the term of this patent is extended or adjusted under 35 U.S.C. 154(b) by 173 days.

(21) Appl. No.: 18/627,135

(22) Filed: Apr. 4, 2024

(65) Prior Publication Data

US 2025/0314419 A1 Oct. 9, 2025

(51) Int. Cl.
*F25D 23/00* (2006.01)
*A47F 3/04* (2006.01)
*F25D 23/06* (2006.01)

(52) U.S. Cl.
CPC ..... *F25D 23/065* (2013.01); *A47F 3/0482* (2013.01); *F25D 2201/10* (2013.01)

(58) Field of Classification Search
CPC ..... F25D 23/065; F25D 23/06; F25D 23/066; F25D 2201/10; F25D 23/062; F25D 23/063; F25D 23/087; A47F 3/0482; A47F 3/04; A47F 3/0404; A47F 3/0439; A47F 3/0469; A47F 5/103; E04C 2/292; E04C 2/296
USPC ..... 312/406, 401, 116, 296; 220/592.09, 220/902; 52/404.4, 578
See application file for complete search history.

(56) References Cited

U.S. PATENT DOCUMENTS 3,014,611 A 12/1961 Marshall
3,112,043 A 11/1963 Tucker
3,240,029 A * 3/1966 Wurtz ..... F25D 23/062 62/298
3,323,267 A 6/1967 Fish
3,823,525 A 7/1974 Bruun
4,486,994 A 12/1984 Fisher et al.
5,475,987 A * 12/1995 McGovern ..... A47F 3/0447 62/256
5,830,308 A 11/1998 Reichard
(Continued)

FOREIGN PATENT DOCUMENTS

CN 209636994 U * 11/2019
DE 10050312 A1 * 4/2002 ..... F25D 23/063
(Continued)

OTHER PUBLICATIONS

English translation of DE10050312 (Year: 2002).*
KR2007069009 English translation (Year: 2007).*

*Primary Examiner* — Janet M Wilkens
(74) *Attorney, Agent, or Firm* — Fish & Richardson P.C.

(57) ABSTRACT

Implementations of the present disclosure include an insulated case that includes a first insulated panel and a second insulated panel. The first insulated panel includes a first foam core sandwiched between a first pair of thermally conductive sheets. The first insulated panel includes a first end face. The second insulated panel includes a second end face that is bonded to the first end face by a thermally insulated joint. The thermally insulated joint includes a continuous layer of cured foam and a continuous layer of non-foam sealant. The continuous layer of cured foam is bonded to both the first end face and the second end face extending along a mated length between the first and second end faces. The continuous layer of non-foam sealant is bonded to both the first end face and the second end face and is adjacent to an outer edge of the layer of cured foam.

21 Claims, 5 Drawing Sheets

(56) References Cited

U.S. PATENT DOCUMENTS

| | | | | |
|---|---|---|---|---|
| 6,314,701 | B1 * | 11/2001 | Meyerson | E04C 2/292 52/592.1 |
| 7,036,285 | B2 | 5/2006 | Hunter, Jr. | |
| 8,511,766 | B2 * | 8/2013 | Sonnenfroh | F25D 23/062 312/401 |
| 8,522,500 | B1 * | 9/2013 | Brown | E04B 1/14 52/404.4 |
| 10,471,626 | B1 | 11/2019 | Dumuk et al. | |
| 11,980,300 | B2 | 5/2024 | Eget et al. | |
| 2007/0289976 | A1 * | 12/2007 | Meyer | F25D 17/06 220/592.09 |
| 2009/0255204 | A1 | 10/2009 | Schwartau | |
| 2011/0162403 | A1 | 7/2011 | Selin et al. | |
| 2013/0213074 | A1 | 8/2013 | Nguyen et al. | |
| 2017/0007039 | A1 | 1/2017 | Resch | |
| 2018/0180350 | A1 | 6/2018 | Yoon et al. | |
| 2020/0299960 | A1 * | 9/2020 | Sharma | B29C 44/18 |
| 2022/0175156 | A1 | 6/2022 | Eget et al. | |
| 2024/0277161 | A1 | 8/2024 | Eget et al. | |
| 2024/0302095 | A1 * | 9/2024 | Zhang | F25D 23/063 |

FOREIGN PATENT DOCUMENTS

| | | | | | |
|---|---|---|---|---|---|
| EP | 0957213 | A1 | * | 11/1999 | E04C 2/292 |
| GB | 2081335 | A | | 2/1982 | |
| JP | H09178338 | A | * | 7/1997 | |
| KR | 10-1999-0004868 | U | | 2/1999 | |
| KR | 2007069009 | A | * | 7/2007 | |
| KR | 10-2012-0004576 | U | | 6/2012 | |

* cited by examiner

INSULATION PANEL SEAL

TECHNICAL FIELD

This disclosure relates to refrigerated display cases and enclosures, and particularly to methods and equipment for making and assembling refrigerated display cases.

BACKGROUND

Refrigerated enclosures are used in commercial and residential applications for storing and displaying refrigerated or frozen objects. Refrigerated enclosures may be maintained at temperatures above freezing (e.g., a refrigerator) or at temperatures below freezing (e.g., a freezer). The walls or casing of refrigerated enclosures can be made with foam panels of different shapes and dimensions. Refrigerated enclosures can leak air through joints, mating surfaces, and other connections. Improvements in the methods and systems for assembling refrigerated display cases are sought.

SUMMARY

Implementations of the present disclosure include an insulated case that includes a first insulated panel and a second insulated panel. The first insulated panel includes a first foam core sandwiched between a first pair of thermally conductive sheets. The first insulated panel forms a first wall of the insulated case and comprises a first end face. The second insulated panel includes a second foam core sandwiched between a second pair of thermally conductive sheets. The second insulated panel forms a second wall of the insulated case and comprises a second end face that is bonded to the first end face of the first insulated panel by a thermally insulated joint. The thermally insulated joint includes a continuous layer of cured foam and a continuous layer of non-foam sealant. The continuous layer of cured foam is bonded to both the first end face and the second end face extending along a mated length between the first and second end faces. The layer of cured foam fills a center portion of the thermally insulated joint. The continuous layer of non-foam sealant is bonded to both the first end face and the second end face and is adjacent to an outer edge of the layer of cured foam. The layer of non-foam sealant extends along an entire length of the layer of cured foam.

In some implementations, the insulated case further includes a second continuous layer of non-foam sealant bonded to both the first end face and the second end face and adjacent to a second outer edge of the layer of cured foam.

In some implementations, the second insulated panel extends along a central plane of the second insulated panel, and the second end face is on a plane normal with respect to the central plane of the second insulated panel.

In some implementations, the first end face comprises a central longitudinal notch such that the first end face defines, in cross section, an indentation between two elevated surfaces, and the layer of cured foam is disposed within the central longitudinal notch.

In some implementations, the layer of cured foam spans the mated length between the first end face and the second end face, and the layer of non-foam sealant extends along one of the two elevated surfaces.

In some implementations, further comprising a second continuous layer of non-foam sealant bonded to both the first end face and the second end face and adjacent to a second outer edge of the layer of cured foam, and the second layer of non-foam sealant extends along a second one of the two elevated surfaces.

In some implementations, one of the second pair of thermally conductive sheets extends outwardly from the second end face to form an overhang, the overhang defining an interface surface normal with respect to the second end face, the insulated case further comprising a second layer of non-foam sealant bonded to the interface surface and to one sheet of the first pair of thermally conductive sheets of the first insulated panel.

In some implementations, the layer of cured foam comprises a continuous layer with a first portion residing between the central longitudinal notch and the second end face, and a second portion residing between one of the elevated surfaces and the second end face.

In some implementations, the thermally conductive sheets have a greater thermal conductivity than the first or second foam cores.

In some implementations, the first insulated panel comprises a non-flat cross-section and the second insulated panel comprises a flat cross-section.

In some implementations, the insulated case comprises a refrigerated display case, the first insulated panel comprises a tank panel forming a base of the refrigerated display case, and the second insulated panel resides on top of the tank panel and forms a back wall of the refrigerated display case.

In some implementations, the layer of non-foam sealant has a greater thermal conductivity than the first foam core, the second foam core, and the cured foam.

In some implementations, the layer of non-foam sealant comprises silicone.

In some implementations, the thermally insulated joint is formed without any injection holes along the mated length.

Implementations of the present disclosure include an insulated product display case that includes a rear wall, a base, and a thermally insulated joint. The rear wall includes a first insulated panel comprising a first foam core residing between a first pair of metal sheets. The first insulated panel includes a first end face at which the first foam core is exposed between the metal sheets. The base has a non-flat cross section and includes a second insulated panel. The second insulated panel includes a second foam core, a cap, and a thermally insulated joint. The second foam core resides between a second pair of metal sheets. The cap bracket covers a longitudinal edge of the second insulated panel and defines a central longitudinal notch. A surface of the cap bracket forms a second end face. The thermally insulated joint is formed between the rear wall and the base. The thermally insulated joint includes a continuous layer of cured foam and a continuous layer of non-foam sealant. The continuous layer of cured foam is disposed within the central longitudinal notch and bonded to both the first end face and the second end face and extending along a mated length between the first and second end faces. The layer of cured foam fills the central longitudinal notch. The continuous layer of non-foam sealant is bonded to both the first end face and the second end face and is adjacent to an outer edge of the layer of cured foam. The layer of non-foam sealant extends along an entire length of the layer of cured foam.

In some implementations, the insulated product display case further includes a top mounted to the rear wall. The top includes a third foam core residing between a third pair of metal sheets. The product display case is an open-front display case. In some implementations, the base includes a vertical portion, a horizontal portion, and an angled portion. The vertical portion is at the rear of the display case. The longitudinal edge forms a top edge of the vertical portion. The horizontal portion extends forward from a bottom of the vertical portion. The angled portion extends outward and upwards at an oblique angle from the horizontal portion.

In some implementations, the central longitudinal notch defines, in cross-section, an indentation between two elevated surfaces, and the layer of non-foam sealant is bonded to the two elevated surfaces and the first insulated panel.

Implementations of the present disclosure include a method of assembling an insulated display case. The method includes laying a continuous bead of liquid foam on a first end face of a first insulated panel. The method also includes laying a continuous bead of non-foam sealant on the first end face. The method also includes positioning a second end face of a second insulated panel proximate and facing the first end face of the first insulated panel. The method also includes attaching the first insulated panel to the second insulated panel by allowing the bead of liquid foam to cure and bond to the first end face and the second end face, forming a thermally insulated joint in which the second end face faces and is bonded to the first end face by a layer of cured foam and a layer of non-foam sealant. The layer of cured foam extends along a mated length between the first and second end faces. The layer of cured foam fills a center portion of the thermally insulated joint. The layer of non-foam sealant is bonded to both the first end face and the second end face and adjacent to an outer edge of the layer of cured foam. The layer of non-foam sealant extends along an entire length of the layer of cured foam.

In some implementations, the position comprises positioning, after laying the continuous bead of liquid foam and the continuous bead of non-foam sealant, the second end face of the second insulated panel proximate the first end face, and the attaching comprises attaching the first insulated panel to the second insulated panel after the positioning.

In some implementations, the second end face comprises a flat cross-section and the first end face comprises a central longitudinal notch such that the first end face defines, in cross-section, an indentation between two elevated surfaces, and the laying comprises laying the bead of liquid foam within the central longitudinal notch, and the attaching comprises allowing the bead of liquid foam to adhere to the longitudinal notch and the second end face.

In some implementations, laying the continuous bead of non-foam comprises laying the continuous bead of non-foam sealant on one of the two elevated surfaces, and the method further comprises laying a second bead of non-foam sealant on the other of the two elevated surfaces.

DETAILED DESCRIPTION OF THE DISCLOSURE

The present disclosure describes methods for attaching insulated foam panels with a thermally insulated seal. The present disclosure also describes insulated foam panels that improve the process of assembling and installing refrigerated enclosures. The foam panels can be used for various products or building materials that require insulation, e.g., a refrigerated display case chassis, doors, wall panels, etc. For example, a refrigerated display case chassis is an assembly that includes a tank (e.g., a base where a commercial refrigerator display case sits), a canopy that extends above the refrigerator display, and a back panel or wall that connects the tank to the canopy. Each of these components can be made of one or more insulated foam panels.

Figure 1:
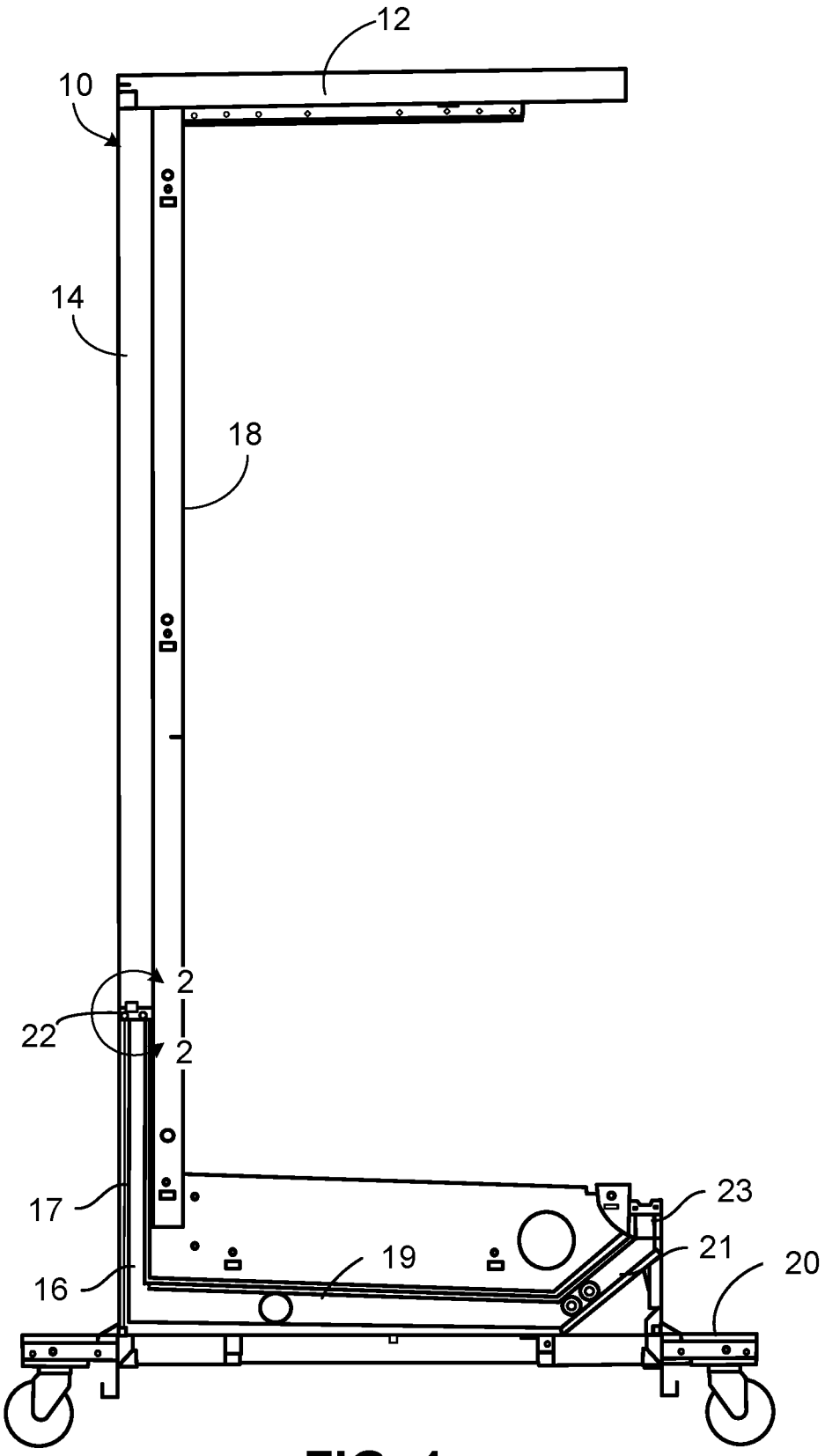
FIG. 1 is a side view of a refrigerated display case according to implementations of the present disclosure.

FIG. 1 illustrates a side view of a refrigerated display case chassis 10. For example, the refrigerated display case chassis 10 can be part of any type of refrigerated display case 11 such as a refrigerator, a freezer, or other enclosure (or partial enclosure) defining a temperature-controlled space. Specifically, the refrigerated display case chassis 10 can form the base, back wall, and roof of the refrigerated display case 11. The refrigerated display case 11 can have side walls (not shown) made of insulated foam panels or a different material. In some examples, the refrigerated display case 11 has an open front (e.g., as shown in FIG. 1). In some examples, one or more doors can be mounted to a door frame attached to the open front of the display case 11.

If configured as an open-front display case, the refrigerated display case may have a front sill structure (not shown) comprised of aesthetic panels and/or protective bumpers that deflect shopping carts. An open-front display case provides unimpeded or open access above the front sill to the temperature-controlled space. If configured as a door-case (e.g., a closed case), the front area of the refrigerated display case may include one or more doors (not shown) for accessing the refrigerated or frozen objects within the temperature-controlled space.

The refrigerated display case chassis 10 has multiple insulated panels (e.g., foam panels) 12, 14, 16 that form the top, back wall, and base respectively. Specifically, the refrigerated display case chassis 10 has a base panel 16 (e.g., a tank panel), a top panel 12 (e.g., a canopy panel), and a back panel 14 connecting the base and top panels 16, 12. The base panel 16 forms the floor of the refrigerated display case, the back panel 14 forms the back wall of the refrigerated display case, and the top panel 12 forms the roof of the refrigerated display case.

The top panel 12 and back panel 14 are flat and the base panel 16 has a non-flat cross-section. For example, the base panel 16 has a back vertical portion 17, a horizontal portion 19 extending from the vertical portion 17 at the rear of the display case 11 towards the front of the display case 11, an angled portion 21 extending from the horizontal portion 19 out and upwards at an oblique angle to the horizontal portion 19, and a front vertical portion 23 forming a front edge at an opening of the display case 11. The back vertical portion 17 of the base panel 16 is attached to the back panel 14.

The refrigerated display case chassis 10 also includes a base frame 20 and middle brackets 18 that form the upper frame of the display case 11. The base frame 20 and brackets 18 can be made of metal, hard plastic, or a similar structural material. The base panel 16 rests on the base frame 20. The base frame 20 can have wheels for moving the refrigerated display case chassis 10. The brackets 18 connect and support the three panels 12, 14, 16.

The base panel 16 is attached to the back panel 14 to form a joint 22. The joint 22 is formed by attaching the base panel 16 and back panel 14 with foam and a sealant (e.g., silicone) disposed between the two panels 16, 14. The joint 22 forms an insulated seal that prevents air from passing through the joint 22 and minimizes thermal conduction through the joint 22.

Figure 2:
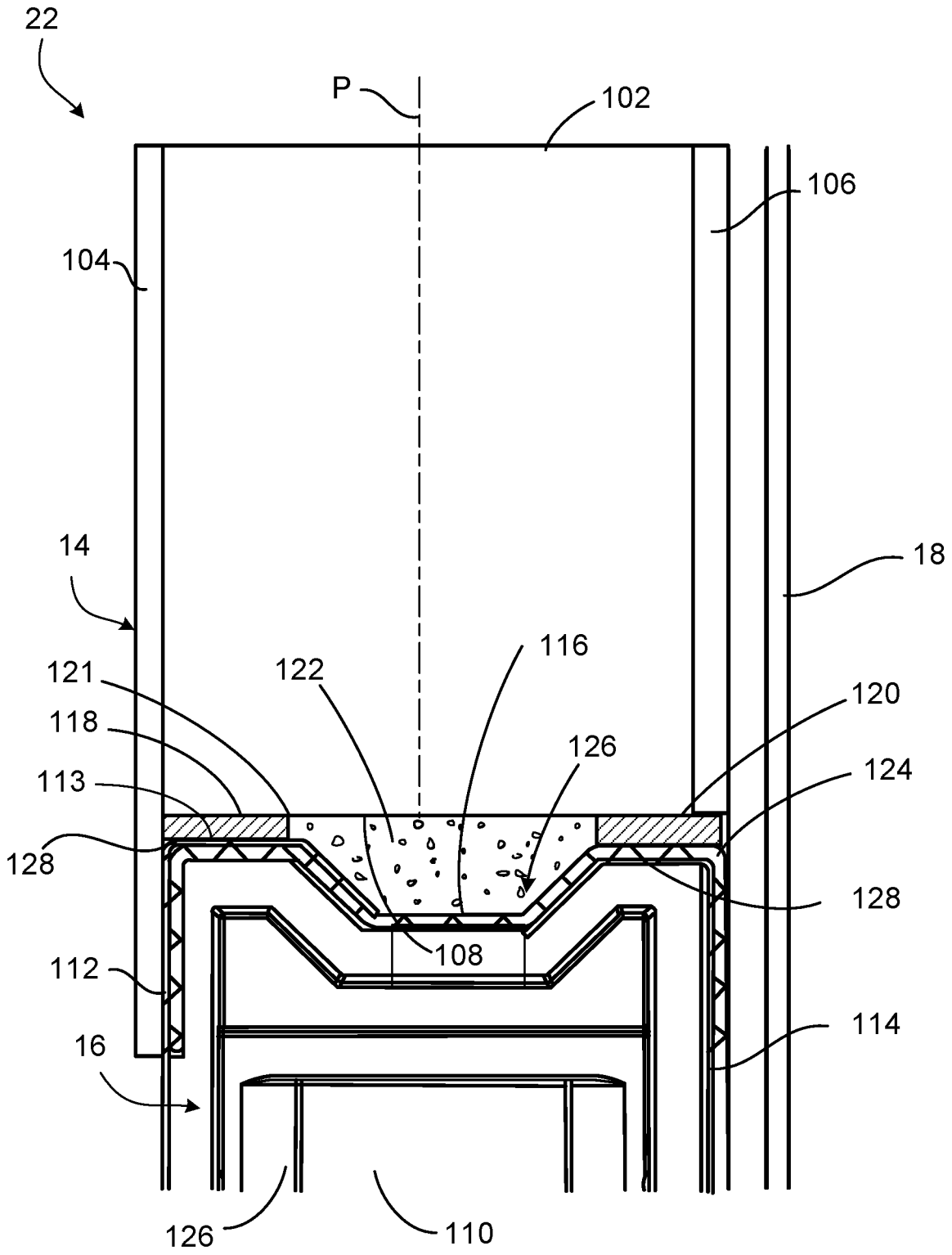
FIG. 2 shows a detailed view of a joint of the refrigerated display case according to a first implementation of the present disclosure, taken along line 2-2 in FIG. 1.

FIG. 2 shows a detailed view of the joint 22 taken along line 2-2 in FIG. 1. As shown in FIG. 2, the back panel 14 has a foam core 102 sandwiched between a first pair of thermally conductive (e.g., metal) sheets 104, 106. The thermally conductive sheets 104, 106 have a greater thermal conductivity than the foam core 102. The back panel 14 has an end face 108 facing the base panel 16. The end face 108 is a foam surface that is exposed before assembly.

The base panel 16 has a foam core 110 sandwiched between a second pair of thermally conductive sheets 112, 114. The base panel has an end face 116 that, when assembled, faces the end face 108 of the back panel 14. The end face 116 is made of a cap bracket 124 and a tab 113 of the sheet 112 of the base panel 16. For example, the base panel 16 has a cap bracket 124 (e.g., an M-shaped longitudinal bracket) that overlaps a tab 115 of the lower sheet 114 and is disposed under a tab 113 of the upper sheet 112. The cap bracket 124 can be made of plastic, metal, or a similar material such as a composite.

The base panel 16 also has end caps 126 (e.g., side caps) on each end of the base panel 16. The end caps 126 form an edge of the base panel 16 and can include a reinforcement core (e.g., a honeycomb core, a truss core, or a similar core) that adds structural reinforcement to the base panel 16.

The bracket 124 forms a longitudinal notch 127 where foam 122 is disposed in liquid form during assembly. The longitudinal notch 127 defines, in cross-section, an indentation between two elevated surfaces 128. Together, the base panel 16 and back panel 14 are bonded to form the thermally insulated joint 22 in which the two faces 108, 116 are bonded to one another. In some examples, the faces 108, 116 are bonded by two separate layers of silicone 118, 119 (or another type of non-foam sealant), and the layer of foam 122 disposed therebetween. The two beads of sealant can have a greater thermal conductivity than the foam 122 and the foam core 102.

To form the base panel 16 the two sheets 112, 114, the cap bracket 124, and the end caps 126 are first assembled and then foam is injected the into a cavity or volume formed between the two sheets 112, 114, the cap bracket 124, and bounded at the sides by the end caps 126. The longitudinal notch 127 formed by the cap bracket 124 allows a substantial amount of foam 122 to be disposed between the base panel 16 and the back panel 14 to form the thermally insulated joint 22. The thermally insulated joint extends from the back sheet 104 of the back foam panel to a back sheet 13 that overlays at least part of both foam panels 12, 14.

Once the thermally insulated joint 22 is formed, the layer of cured foam 122 fills the central longitudinal notch 127 and is bounded on each side by the layers of silicone 118, 120. The layers of silicone 118, 120 reside between the elevated surfaces 128 and the back panel 14. Once the foam 122 cures, the cured foam 122 and layers of silicone 118, 120 bond to both panels 14, 16 to form a fluid-tight seal to prevent air from escaping or entering the display case through the joint 22. The longitudinal notch 127 spans the length of the first end face 116 such that, when cured, the foam 122 is exposed at both ends of the joint 22.

The back panel 14 extends along a central plane "P" of the back panel 14, and the second end face 108 extends along a plane that is normal with respect to the central plane "P" of the back panel 14. The first end face 116 is also normal with respect to the central plane "P." Once the joint 22 is formed, the panels 14, 16 can be attached (e.g., bonded with an adhesive) to the frame brackets 18 of the refrigerated display case.

Figure 3A:
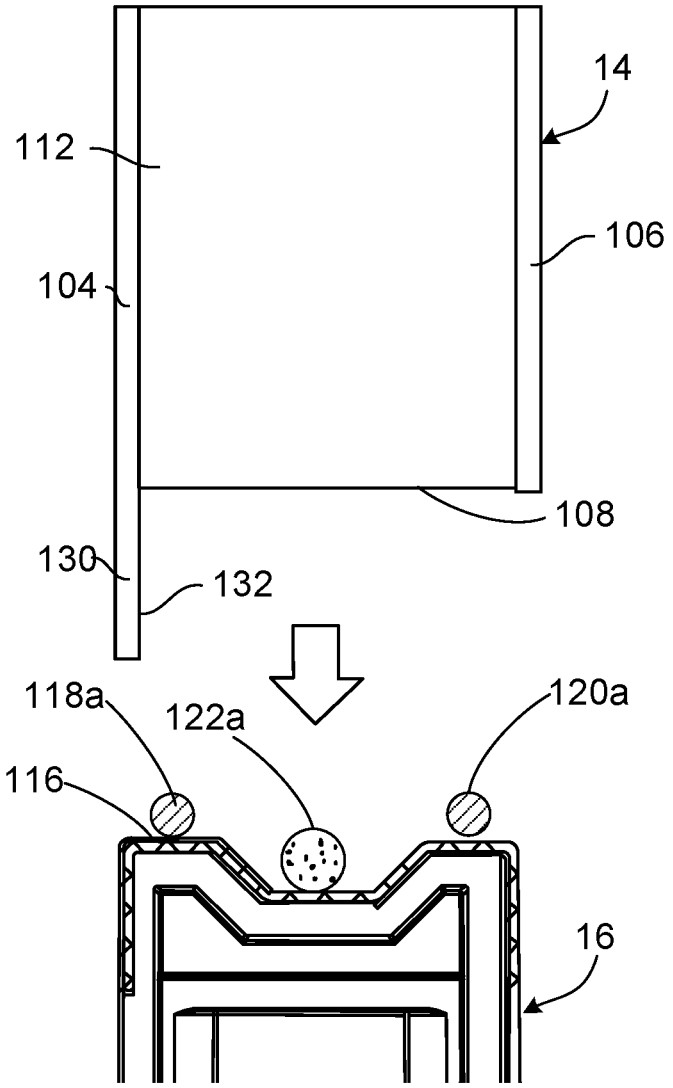
FIG. 3A shows a detailed view of a step to form the joint shown in FIG. 2.

Referring also to FIG. 3A, to form the thermally insulated joint, the liquid foam 122*a* (e.g., a foam bead) and liquid silicone 118*a*, 120*a* (e.g., silicone beads) are first laid on the first end face 116. The bead of liquid foam 122*a* and beads of liquid silicone 118*a*, 120*a* can be poured as a single, continuous bead that span all or substantially all the length of the base panel 16. For example, the bead of liquid foam 122*a* is a continuous layer bounding the full length of the foam layer. In some aspects, the liquid foam and liquid silicone can be poured as separate parts or discontinuous beds that, when compressed and cured, attach to each other.

Before the liquid foam 122*a* and liquid silicone 118*a*, 120*a* cure, the back panel 14 is brought close into contact with the liquid foam 122*a* and liquid silicone 118*a*, 120*a*. For example, the back panel 14 is pressed against the base panel 16 until the liquid foam 122*a* and liquid silicone 118*a*, 120*a* cure and bond the two panels 14, 16 together. With the end faces 108, 116 facing each other, the faces 108, 116 are bonded together as the liquid foam 122*a* and liquid silicone cure.

Thus, as shown in FIG. 2, the joint 22 is formed of a continuous layer of cured foam 122 bonded to both the faces 108, 116. The continuous layer of cured foam 122 extends along a mated length between the first and second end faces 108, 116. In some aspects, the mated length is a length along which the two faces are mated, and includes the entire length of both panels 16, 14. The joint 22 also includes one or more continuous layers of layer of silicone 118, 120 bonded to both end faces 108, 116 and adjacent to an outer edge 121 of the layer of cured foam 122. The layer of silicone 118, 120 extends along the entire length of the layer of cured foam.

The liquid foam 122*a* can be a polyurethane foam (PUR) that, when cured, becomes rigid or substantially rigid. The liquid foam 122*a* can be designed so that its cure time is such that it allows the foam to be laid on the base panel and then bring the back panel into close proximity to the base panel before the foam begins to cure. For example, the foam can be designed to have specific properties of its reaction profile as well as specific end-product qualities. For example, the chemicals (e.g., catalysts, reaction inhibitors, and the like) and proportions of chemicals in the foam can be changed to create different qualities in the end-product (e.g., changing the fire-retardant properties of the cured foam) and change the properties of the reaction profile.

In some aspects, the properties of the reaction profile include cream time, gel time, rise time, and tack-free time. Cream time refers to the time it takes from the initial laying to the time the two-part chemicals of the foam begin to mix and react. Gel time can refer to the time it takes for the foam to begin expanding and polymerizing. Rise time can refer to the time it takes for the foam to reach its maximum volume or height. Tack-free time can refer to the time it takes for the reaction to be complete, which is when the final foam product can be handled. For example, the foam can have a cream time of between 5 and 20 seconds, a gel time of between 50 and 120 seconds, a rise time of between 75 and 160 seconds, and a tack-free time of between 110 and 230 seconds. Moreover, the temperatures (e.g., the ambient temperature or surface temperature) can be changed to influence the properties of the reaction profile. For example, the gel time can double for each 10-degree Celsius decrease in temperature.

In some aspects, the silicone 118*a*, 120*a* is a sealant that, when cured, remains flexible and acts as water and moisture repellent. For example, the silicone can be an acetoxy silicone, an oxime silicone, or an alkoxy silicone. In some aspects, instead of silicone 118, 120, the sealant can be a latex caulk, acrylic latex, or adhesive caulk.

Once the liquid foam 122*a* cures it forms an insulated joint 22 that has a thermal conductivity that is less than the thermal conductivity of the pair of sheets 104, 106. The insulated joint 22 prevents air or fluid from flowing across the joint 22 and thermally insulates the interior of the refrigerated display case from the exterior of their refrigerated display case.

Figure 3B:
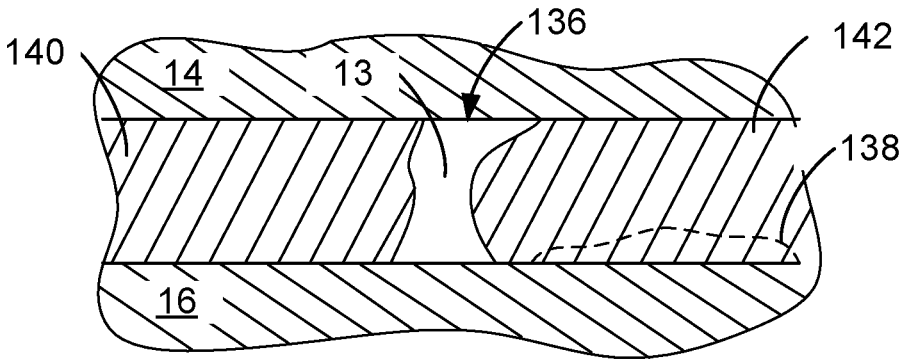
FIG. 3B shows a back, cross-sectional view of a section of a joint formed by injecting foam from two opposite locations instead of laying the foam.

Laying the beads of foam 122*a* (and silicone 120*a*) before attaching the foam panels 14, 16 allows the liquid foam (and silicone) to form a continuous, uninterrupted layer that bonds the insulated boards 14, 16. Specifically, the continuous layer is void of "knit lines." Referring also to FIG. 3B, a knit line 136 or void is any line or gap, visible or not, where two foam sections 140, 142 (e.g., two resin flows) meet or face one another. FIG. 3B shows an example of a knit line formed when the liquid foam is injected from two opposite ends instead of laying a continuous bead of foam, as described herein. In a knit line or void, air becomes trapped between the two opposing foam flows, which can decrease the insulating effect of the refrigerated display case. As shown, the knit line 136 extends between the two cured foam sections 140, 142, and also along the thickness of the insulated boards 14, 16, from the back sheet 13 of the display to the back sheet 104 (see FIG. 2) of the upper foam panel 14.

In some aspects, air migrates and moves (e.g., via natural convection), within the knit line 136, decreasing the insulation effect of the refrigerated display case. Specifically, a continuous volume of air that spans the thickness of the foam panels 14, 16 allows air to migrate directly from the inside (cooled air) of the refrigerated display case to the outside (hotter, ambient air) of the refrigerated display case. Such effect is more disruptive to the cooling of the refrigerated display case than a void 138 oriented along the case length axis. Specifically, the void 138 extends parallel and only along the inside sealing surface, adjacent the back sheet 13 but not extending to the back sheet 104 (see FIG. 2) of the upper foam panel 14. Thus, inside the void 138, the air that touches the interior of the refrigerated display case does not touch the exterior of the refrigerated display case.

Applying a continuous layer of foam in the length direction of the case inherently reduces the opportunity of knit lines 136 that are oriented from the inside to the outside of the refrigerated display case. By contrast, multiple injection points spaced at some frequency along the length of the case introduce multiple potential knit lines where the opposing foam flows meet, which can be at several points along the length of the case. Preventing the formation of knit lines by laying a continuous bead of foam can help increase and preserve the insulative and structural integrity of the joint.

Furthermore, forming the joint 22 by laying the beads of foam and silicone before attaching the foam panels 14, 16 eliminates the need for any injection holes along the edge or at the ends of panels 14, 16 or the thermally insulated joint. In other words, the panels 14, 16 can be joined without any injection holes through the metal sheets 104, 106.

Additionally, laying a continuous bead of foam and silicone prevents the foam and silicone from traveling through a tortuous path. For example, injecting foam through an open end (or a hole) of a gap defined between two panels can cause the foam and silicone to travel through a tortuous path (e.g., a narrow gap, and a path of twists and turns). A tortuous path can cause the uneven distribution of the foam and silicone and uneven cured pressures that can cause problems in the future.

In some aspects, attaching the two panels 14, 16 can be done by first attaching (or bringing into close proximity) the two panels, and then laying a continuous foam bead using a long nozzle fully inserted, through one side, into the cavity formed between the two panels 14, 16 and then laying the resin as the nozzle is pulled out of the cavity. Such nozzle can have a length similar to the length of the panels 14, 16 such that, when fully inserted, the tip of the nozzle is at the opposite end of the cavity. Alternatively, two nozzles can be used by inserting one of the nozzles through each opposite end of the cavity. Each of the two nozzles can have a length that is about half the length of the panels 14, 16 such that fully inserting each nozzle positions the tip of the nozzle at or near a middle point of the length of the panels 14, 16.

In some aspects, the back sheet 104 of the back panel 14 extends outwardly from the second end face 108 to form an overhang 130. The overhang 130 defines an interface surface 132 that is normal with respect to the end face 108 of the back panel 14. The interface surface 132 interfaces with the rear-facing surface of the base panel 16. In some aspects, the overhang 130 serves as a barrier to prevent the silicone 118*a* from bleeding out and being exposed at the back of the joint 22. In some aspects, the front sheet 106 can alternatively or additionally have an overhang. Also, the base panel 16 can have one or more overhangs, and, in some cases, none of the foam panels 14, 16 have an overhang.

In some implementations, to form the overhang 130, the back panel 14 can first be formed with two equally or substantially equally sized sheets 104, 106. For example, the two sheets 104, 106 can terminate at a common plane parallel with respect to the end face 108 of the back panel. Once the two sheets 104, 106 are attached to the foam core 102, the back panel 14 can be machined as to cut one sheet 106 and the foam core 102 up to the other sheet 104 but without cutting the other sheet 104, thereby forming the overhang 130.

In some aspects, the joint 22 can be implemented in any board-to-board connection in which two end faces of the boards face each other. For example, the joint 22 can also be a vertical joint extending along the height of the back panel 14 to attach two back panels 14 next to each other.

Figure 5:
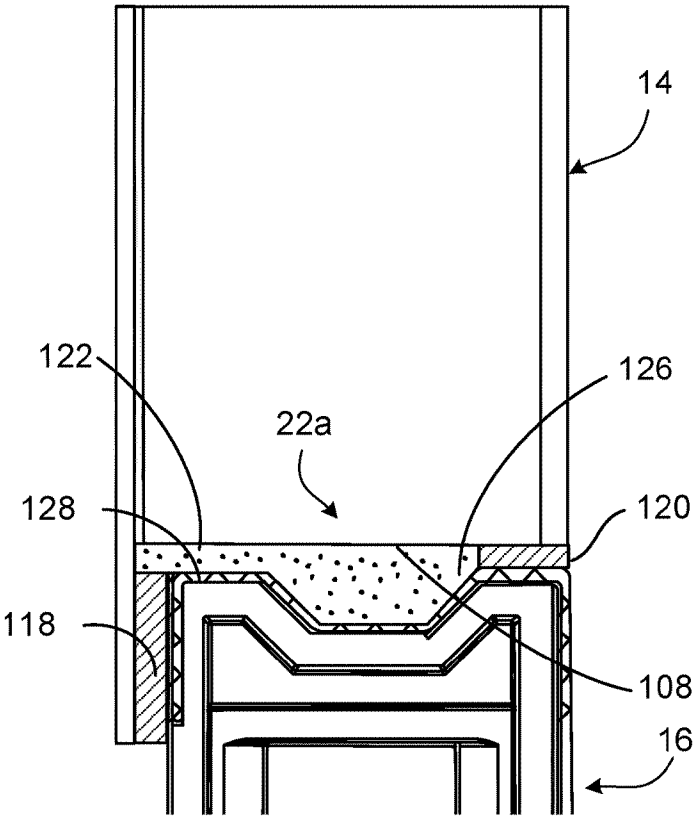
FIGS. 4-5 show sequential steps of forming a joint according to a second implementation of the present disclosure.
Figure 4:
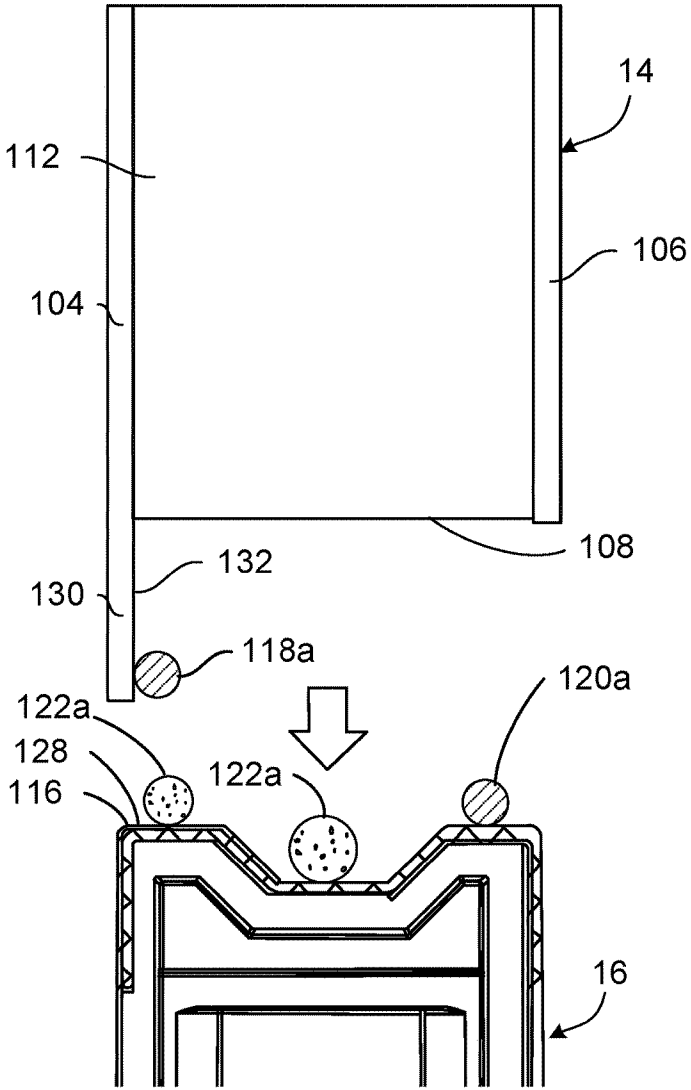

FIGS. 4 and 5 show sequential steps of forming a joint 22*a* according to a second implementation of the present disclosure. Similar to the joint 22 in FIG. 2, the joint 22*a* is formed by first laying a bead of liquid foam 122*a* and two beads of liquid silicone 118*a*, 120*a*, and then attaching the two foam panels 14, 16. One bead of liquid silicone 118*a* is laid on the interface surface 132 of the overhang 130. Alternatively, the bead of liquid silicone 118*a* can be disposed on the rear-facing surface of the base panel 16 near the and face 116 of the base panel 16. With the foam and silicone disposed on their respective surfaces, the back panel 14 is brought into close proximity to the base panel 16 to attach the two panels 14, 16. Once the two foam panels 14, 16 are brought together, they can be attached by mechanical fasteners (not shown) to the frame bracket 18 (FIG. 1) before or after the foam cures.

Placing the layer of silicone 118 on the overhang 130 allows more foam 122 to be used in the joint trying 22*a*, which can increase the amount of insulation provided by the joint 22*a*. For example, to form the joint, one bed of enough liquid foam 122*a* can be laid on the longitudinal notch 127 so that, when the bed of liquid foam expands, it extends into the gap between the elevated surfaces 128 and the back panel 14.

In some aspects, to form the joint 22*a*, a first bead of foam can be laid on the longitudinal notch 127 and a second bead of foam can be laid on the back of one of the elevated surfaces 128 so that, when cured, the foam layer spans the notch 127 and the elevated surface 128. As shown in FIG. 5, once the foam expands, the cured foam 122 forms a continuous layer that has two portions. A first portion resides, in cross section, between the central longitudinal notch 127 and the second end face 108, and a second portion resides between one of the elevated surfaces 128 and the second end face 108.

In some aspects, the front bead of silicone 120*a* can be substituted by liquid foam 122*a* so that the entire region between the respective end surfaces of the back panel 14 and the base panel 16 is made of foam 122, with the layer of silicone 118 forming a barrier between the foam and the ambient environment.

Figure 6:
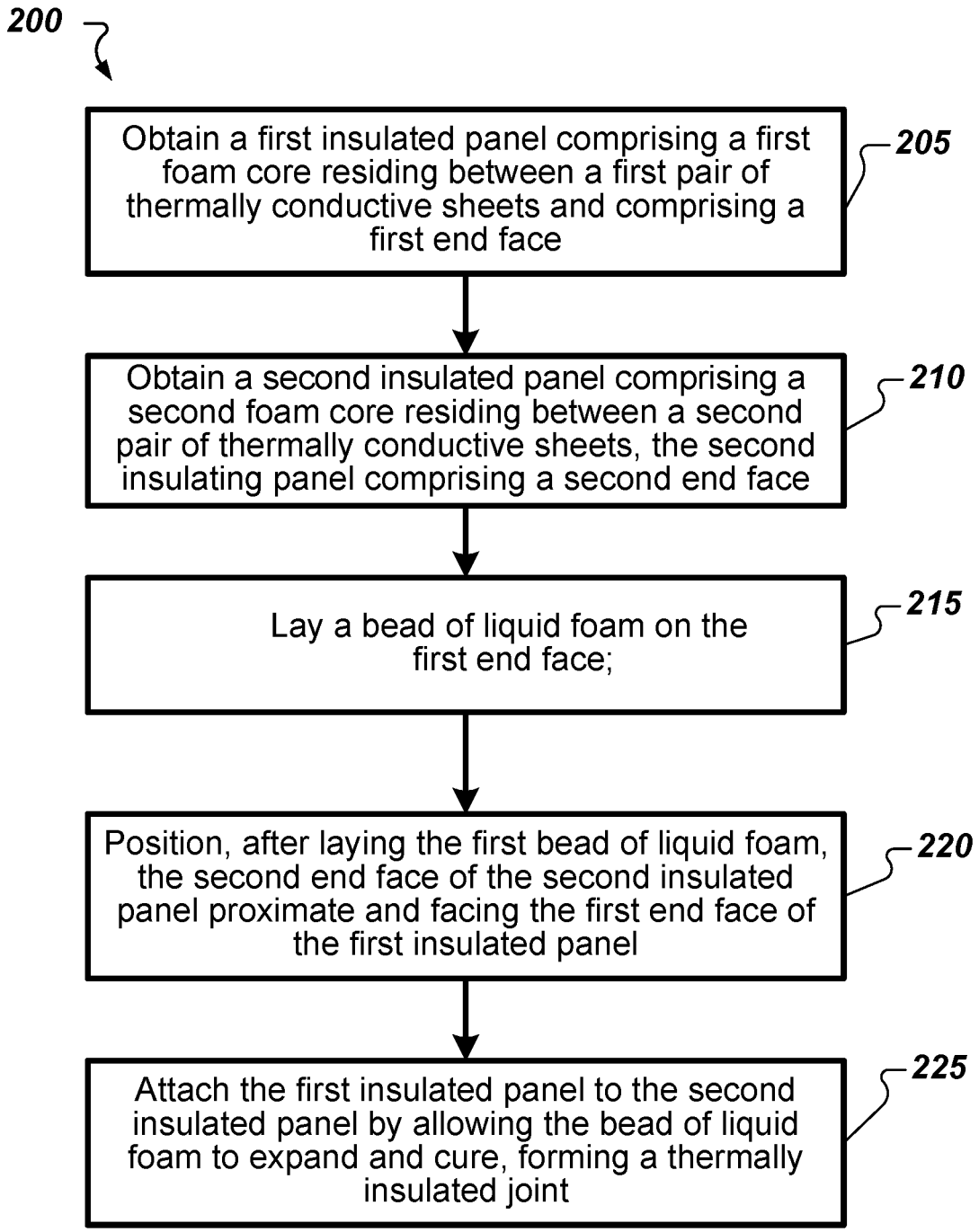
FIG. 6 shows a flow chart of an example method of forming an insulated joint.

FIG. 6 shows a flow chart of a process (200) for assembling an insulated display case. The process includes obtaining a first insulated panel that has a first foam core between a first pair of thermally conductive sheets and has a first end face (205), and obtaining a second insulated panel that has a second foam core residing between a second pair of thermally conductive sheets and a second end face (210). In some implementations, one of the first or second insulated panels is machined to form an overhang on one of the thermally conductive sheets at an end face of the panel, e.g., as depicted in FIGS. 4 and 5.

A bead of liquid foam is laid on the first end face (215). For example, a continuous bead of liquid foam is laid along an entire length of the first end face that will be mated with a corresponding second end face of the second insulated panel. The bead of liquid foam can, thus, extend along the entire mated length of the first end face, where the mated length is the full length of a thermally insulated joint formed between respective end faces of both the first and second insulated panels. In some examples, the liquid foam can be laid down on the first end face in a series of consecutive beads, with gaps between the beads. The gaps can be sized such that they are shorter than a distance by which the liquid foam is expected to expand when pressed against the end face of the second insulated panel such that the gaps will be filled to create a continuous layer of cured foam after the liquid foam cures.

In some implementations, one or more beads of non-foam sealant are laid along outer edges of the end face of the first insulated panel. The non-foam sealant can be applied before the liquid foam is applied. In some examples, two continuous beads of non-foam sealant are laid down on along opposite outer edges of the end face of the first insulated panel. The beads can extend along an entire long an entire length of the first end face that will be mated with a corresponding second end face of the second insulated panel. The liquid foam can then be laid between the two beads of non-foam sealant. The non-foam sealant then forms boundaries for expansion of the liquid foam as it cures. In some implementations one of the non-foam beads is laid on an inner surface of an overhang at the end face of one of the first or second insulated panels, e.g., as depicted in FIG. 4.

After laying the first bead of liquid foam, the second end face of the second insulated panel is positioned proximate and facing the first end face of the first insulated panel (220). The first insulated panel is attached to the second insulated panel (225). For example, the first insulated panel and the second insulated panel are pressed together to seal the liquid foam against the respective end faces of each panel. The liquid foam is allowed to expand and cure, forming a thermally insulated joint in which the second end face faces and is bonded to the first end face, with the first insulated panel forming a first wall of the insulated display case, and the second insulated panel forming a second wall of the insulated display case.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

What is claimed is:

1. An insulated case comprising:

a first insulated panel comprising a first foam core sandwiched between a first pair of thermally conductive sheets, the first insulated panel forming a first wall of the insulated case and comprising a first end face, wherein the first end face comprises a central longitudinal notch such that the first end face defines, in cross section, an indentation between two elevated surfaces; and a second insulated panel comprising a second foam core sandwiched between a second pair of thermally conductive sheets, the second insulated panel forming a second wall of the insulated case and comprising a second end face that is bonded to the first end face of the first insulated panel by a thermally insulated joint comprising:

a continuous layer of cured foam disposed within the central longitudinal notch of the first end face and bonded to both the first end face and the second end face extending along a mated length between the first and second end faces, the layer of cured foam filling a center portion of the thermally insulated joint, and a continuous layer of non-foam sealant extending along one of the two elevated surfaces of the first end face and bonded to both the first end face and the second end face and adjacent to an outer edge of the layer of cured foam, the layer of non-foam sealant extending along an entire length of the layer of cured foam.

2. The insulated case of claim 1, further comprising a second continuous layer of non-foam sealant bonded to both the first end face and the second end face and adjacent to a second outer edge of the layer of cured foam.

3. The insulated case of claim 1, wherein the second insulated panel extends along a central plane of the second insulated panel, and the second end face is on a plane normal with respect to the central plane of the second insulated panel.

4. The insulated case of claim 1, wherein the layer of cured foam spans the mated length between the first end face and the second end face.

5. The insulated case of claim 4, further comprising a second continuous layer of non-foam sealant bonded to both the first end face and the second end face and adjacent to a second outer edge of the layer of cured foam, and the second layer of non-foam sealant extends along a second one of the two elevated surfaces.

6. The insulated case of claim 4, wherein one of the second pair of thermally conductive sheets extends outwardly from the second end face to form an overhang, the overhang defining an interface surface normal with respect to the second end face, the insulated case further comprising a second layer of non-foam sealant bonded to the interface surface and to one sheet of the first pair of thermally conductive sheets of the first insulated panel.

7. The insulated case of claim 4, wherein the layer of cured foam comprises a continuous layer with a first portion residing between the central longitudinal notch and the second end face, and a second portion residing between one of the elevated surfaces and the second end face.

8. The insulated case of claim 1, wherein the thermally conductive sheets have a greater thermal conductivity than the first or second foam cores.

9. The insulated case of claim 1, wherein the first insulated panel comprises a non-flat cross-section and the second insulated panel comprises a flat cross-section.

10. The insulated case of claim 9, wherein the insulated case comprises a refrigerated display case, the first insulated panel comprises a tank panel forming a base of the refrigerated display case, and the second insulated panel resides on top of the tank panel and forms a back wall of the refrigerated display case.

11. The insulated case of claim 1, wherein the layer of non-foam sealant has a greater thermal conductivity than the first foam core, the second foam core, and the cured foam.

12. The insulated case of claim 1, wherein the layer of non-foam sealant comprises silicone.

13. The insulated case of claim 1, wherein neither the first insulated panel nor the second insulated panel have injection holes along the mated length.

14. An insulated product display case, comprising:

a rear wall comprising a first insulated panel comprising a first foam core residing between a first pair of metal sheets, the first insulated panel comprising a first end face at which the first foam core is exposed between the metal sheets;

a base having a non-flat cross section and comprising a second insulated panel comprising:

a second foam core residing between a second pair of metal sheets, and a cap bracket covering a longitudinal edge of the second insulated panel and defining a central longitudinal notch, a surface of the cap bracket forming a second end face; and a thermally insulated joint formed between the rear wall and the base, the thermally insulated joint comprising:

a continuous layer of cured foam disposed within the central longitudinal notch and bonded to both the first end face and the second end face and extending along a mated length between the first and second end faces, the layer of cured foam filling the central longitudinal notch, and a continuous layer of non-foam sealant bonded to both the first end face and the second end face and adjacent to an outer edge of the layer of cured foam, the layer of non-foam sealant extending along an entire length of the layer of cured foam.

15. The insulated product display case of claim 14, further comprising: a top mounted to the rear wall, the top comprising a third foam core residing between a third pair of metal sheets, wherein the product display case is an open-front display case.

16. The insulated product display case of claim 14, wherein the base comprises:

a vertical portion at the rear of the display case, wherein the longitudinal edge forms a top edge of the vertical portion;

a horizontal portion extending forward from a bottom of the vertical portion; and an angled portion extending outward and upwards at an oblique angle from the horizontal portion.

17. The insulated product display case of claim 14, wherein the central longitudinal notch defines, in cross-section, an indentation between two elevated surfaces, and the layer of non-foam sealant is bonded to the two elevated surfaces and the first insulated panel.

18. A method of assembling an insulated display case, the method comprising:

laying a continuous bead of liquid foam on a first end face of a first insulated panel comprising a first foam core residing between a first pair of thermally conductive sheets, wherein the first end face comprises a central longitudinal notch such that the first end face defines, in cross section, an indentation between two elevated surfaces, and wherein the continuous bead of liquid foam is disposed within the longitudinal notch;

laying a continuous bead of non-foam sealant along one of the two elevated surfaces the first end face;

positioning a second end face of a second insulated panel proximate and facing the first end face of the first insulated panel, the second insulated panel comprising a second foam core residing between a second pair of thermally conductive sheets; and attaching the first insulated panel to the second insulated panel by allowing the bead of liquid foam to cure and bond to the first end face and the second end face, forming a thermally insulated joint in which the second end face faces and is bonded to the first end face by a layer of cured foam and a layer of non-foam sealant, the layer of cured foam extending along a mated length between the first and second end faces, the layer of cured foam filling a center portion of the thermally insulated joint, and the layer of non-foam sealant bonded to both the first end face and the second end face and adjacent to an outer edge of the layer of cured foam, the layer of non-foam sealant extending along an entire length of the layer of cured foam.

19. The method of claim 18, wherein the position comprises positioning, after laying the continuous bead of liquid foam and the continuous bead of non-foam sealant, the second end face of the second insulated panel proximate the first end face, and the attaching comprises attaching the first insulated panel to the second insulated panel after the positioning.

20. The method of claim 18, wherein the second end face comprises a flat cross-section and the attaching comprises allowing the bead of liquid foam to adhere to the longitudinal notch and the second end face.

21. The method of claim 18, wherein the method further comprises laying a second bead of non-foam sealant on the other of the two elevated surfaces.

* * * * *